US012687332B2

(12) United States Patent
Kadowaki et al.

(10) Patent No.: US 12,687,332 B2
(45) Date of Patent: Jul. 21, 2026

(54) HEAT PUMP DEVICE AND HOT WATER SUPPLY DEVICE

(71) Applicant: Mitsubishi Electric Corporation, Tokyo (JP)

(72) Inventors: Kimitaka Kadowaki, Tokyo (JP); Yota Maema, Tokyo (JP); Masahiro Ito, Tokyo (JP); Shunya Gyotoku, Tokyo (JP); Kosuke Kawano, Tokyo (JP); Akinori Kurachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 265 days.

(21) Appl. No.: 18/551,763

(22) PCT Filed: May 28, 2021

(86) PCT No.: PCT/JP2021/020343

§ 371 (c)(1),
(2) Date: Sep. 21, 2023

(87) PCT Pub. No.: WO2022/249437

PCT Pub. Date: Dec. 1, 2022

(65) Prior Publication Data

US 2024/0175614 A1 May 30, 2024

(51) Int. Cl.
*F25B 49/02* (2006.01)
*F24H 4/02* (2022.01)

(52) U.S. Cl.
CPC ..... *F25B 49/02* (2013.01); *F24H 4/02* (2013.01); *F25B 2700/1933* (2013.01)

(58) Field of Classification Search
CPC ..... F25B 49/02; F25B 2700/1933; F25B 2313/003; F25B 2313/0253;
(Continued)

(56) References Cited

U.S. PATENT DOCUMENTS 4,393,662 A * 7/1983 Dirth ..... G05D 23/1917 236/46 F
2006/0090502 A1* 5/2006 Taras ..... F24F 3/153 62/513

(Continued)

FOREIGN PATENT DOCUMENTS

JP 2005-147584 A 6/2005
JP 2005-233476 A 9/2005

(Continued)

OTHER PUBLICATIONS

CN_204165263_U, machine translation (Year: 2026).*

(Continued)

*Primary Examiner* — Len Tran
*Assistant Examiner* — Kirstin U Oswald
(74) *Attorney, Agent, or Firm* — Posz Law Group, PLC

(57) ABSTRACT

Provided is a main refrigerant circuit in which a compressor having an injection port, a condenser, a main circuit expansion device unit, and an evaporator are connected by pipes to allow refrigerant to circulate in the main refrigerant circuit; an injection pipe an injection expansion device; an outside-air temperature detection device; a suction pressure detection device; and a controller, wherein the main circuit expansion device unit includes a plurality of main circuit expansion devices with different capacities and in a parallel-connected relationship, and during operation, when the controller determines that the temperature of the outside air is equal to or lower than a set temperature, the controller is configured to open the injection expansion device to control an opening degree to select the main circuit expansion device based on the suction pressure to control an opening degree of the selected main circuit expansion device.

18 Claims, 5 Drawing Sheets

(58) Field of Classification Search
CPC ..... F25B 2313/02742; F25B 2400/13; F25B 2600/0251; F25B 2600/0253; F25B 2600/23; F25B 2600/2509; F25B 2600/2513; F25B 2700/2106; F25B 13/00; F25B 41/30; F25B 47/025; F24H 4/02; F24H 15/219; F24H 15/258; F24H 15/269; F24H 15/385; F24H 15/39; F24H 15/421; F24H 15/486; F24D 19/1054; F24D 17/02
USPC ..... 62/115
See application file for complete search history.

(56) References Cited

U.S. PATENT DOCUMENTS

2006/0266060 A1* 11/2006 Choi ..... F25B 41/20 62/196.1
2009/0199581 A1 8/2009 Ushijima et al.
2010/0101248 A1* 4/2010 Lifson ..... F25B 49/02 700/275
2010/0326100 A1* 12/2010 Taras ..... F25B 1/10 62/115
2011/0083456 A1* 4/2011 Wakamoto ..... F25B 41/00 62/115
2011/0308267 A1* 12/2011 Tamaki ..... F25B 49/005 62/430
2012/0227427 A1* 9/2012 Liu ..... F25B 41/39 62/190
2015/0267941 A1* 9/2015 Kato ..... F25B 49/02 62/235.1

FOREIGN PATENT DOCUMENTS

JP 2009-186121 A 8/2009
JP 2012-052736 A 3/2012
JP 2018-155451 A 10/2018
WO 2014/054176 A1 4/2014

OTHER PUBLICATIONS

WO_03064940_A1, machine translation (Year: 2026).*
International Search Report of the International Searching Authority mailed Jul. 20, 2021 in the corresponding International Patent Application No. PCT/JP2021/020343 (and English Translation).

* cited by examiner

FIG. 5

| OUTSIDE-AIR TEMPERATURE [°C] / OUTGOING-WATER TEMPERATURE [°C] | -25 | -20 | -15 | -10 | 5 | 7 | 9 | 10 | 13 | 15 | 20 | 25 | 30 | 35≦ |
|---|---|---|---|---|---|---|---|---|---|---|---|---|---|---|
| 35 | 40 | 40 | 70 | 90 | 84 | 77 | 72 | 65 | 60 | 57 | 53 | 49 | 46 | 43 |
| 45 | 45 | 45 | 75 | 92 | 88 | 85 | 76 | 69 | 64 | 60 | 55 | 51 | 48 | 44 |
| 60 | 50 | 50 | 80 | 100 | 95 | 88 | 83 | 76 | 72 | 69 | 63 | 58 | 53 | 49 |
| 70 | 50 | 50 | 90 | 100 | 100 | 95 | 90 | 84 | 79 | 75 | 68 | 62 | 57 | 50 |

HEAT PUMP DEVICE AND HOT WATER SUPPLY DEVICE

CROSS REFERENCE TO RELATED APPLICATION

This application is a U.S. national stage application of PCT/JP2021/020343 filed on May 28, 2021, the contents of which are incorporated herein by reference.

TECHNICAL FIELD

The present technique relates to a heat pump device and a hot water supply device. Particularly, the present technique relates to operation of the device when an ambient temperature around a heat exchanger serving as an evaporator is low.

BACKGROUND ART

There is a conventional heat pump device that uses a heat pump cycle to supply hot water, to condition air, or to perform similar functions. Basically, the heat pump device has a refrigerant circuit in which devices such as a compressor, a condenser, an expansion device (pressure-reducing device), and an evaporator are connected by refrigerant pipes to allow refrigerant to circulate in the refrigerant circuit. The heat pump device is often separated into two devices to be installed as an outdoor unit located outdoors and an indoor unit.

The heat pump device is installed in a wide variety of environments since it is used for supplying hot water, conditioning air, or for other purposes. In recent years, from the viewpoint of global environment protection, there are an increasing number of cases where heat pump devices that use air as a heat source are introduced even in cold regions, in place of boiler devices that burn fossil fuels for heating. In these circumstances, the heat pump devices are installed even in a low outside-air temperature environment where the temperature of outside air that is the outdoor air is low. The low outside-air temperature environment refers to a condition that the outside-air temperature is equal to or lower than approximately −20 degrees C.

In general, when the heat pump device heats a load such as water or air, a heat exchanger installed outdoors serves as an evaporator. In the low outside-air temperature environment, refrigerant stagnation is more likely to occur in the heat exchanger, the pipe, and other parts in the refrigerant circuit which are installed outdoors.

Due to this phenomenon, when the heat exchanger installed outdoors serves as an evaporator through which the refrigerant exchanges heat with the outside air, a negative pressure is generated on the low-pressure side in the refrigerant circuit, where the refrigerant is at relatively low pressure. In addition, a liquid back phenomenon occurs in which liquid refrigerant is suctioned into the compressor. In view of that, to prevent the liquid refrigerant from flowing from the evaporator to the compressor, the heat pump device includes an accumulator located between the evaporator and the compressor in the refrigerant circuit to store this liquid refrigerant, thereby avoiding the occurrence of the liquid back phenomenon (see, for example, Patent Literature 1).

CITATION LIST

Patent Literature

Patent Literature 1: Japanese Unexamined Patent Application Publication No. 2018-155451

SUMMARY OF INVENTION

Technical Problem

However, the conventional heat pump device includes the accumulator with a large volume, which hinders downsizing of the unit.

It is thus an object of the present disclosure to provide a heat pump device and a hot water supply device that are downsized and can still work even in a low outside-air temperature environment.

Solution to Problem

To solve the above problems, a heat pump device according to one embodiment of the present disclosure includes: a main refrigerant circuit in which a compressor, a condenser, a main circuit expansion device unit, and an evaporator are connected by pipes to allow refrigerant to circulate in the main refrigerant circuit, the compressor having an injection port and being configured to compress and discharge the refrigerant, the refrigerant exchanging heat with a load through the condenser, the main circuit expansion device unit being configured to reduce a pressure of the refrigerant, the refrigerant exchanging heat with outside air through the evaporator; an injection pipe connected at one end to a pipe between the condenser and an expansion device, and connected at an other end to the injection port; an injection expansion device configured to regulate an opening degree to regulate an amount of the refrigerant flowing through the injection pipe; an outside-air temperature detection device configured to detect a temperature of the outside air; a suction pressure detection device configured to detect a suction pressure of the refrigerant to be suctioned into the compressor; and a controller, wherein the main circuit expansion device unit includes a plurality of main circuit expansion devices with different capacities and in a parallel-connected relationship, and during operation, when the controller determines that the temperature of the outside air is equal to or lower than a set operational temperature that is set in advance based on the temperature of the outside air, the controller is configured to open the injection expansion device to control an opening degree thereof, and is configured to select, from among the plurality of main circuit expansion devices of the main circuit expansion device unit, the main circuit expansion device based on the suction pressure to control an opening degree of the selected main circuit expansion device.

A hot water supply device according to another embodiment of the present disclosure includes the heat pump device described above, and supplies hot water.

Advantageous Effects of Invention

In the heat pump device according to one embodiment of the present disclosure, during its operation, the controller opens the injection expansion device based on the outside-air temperature to inject refrigerant to the compressor through the injection pipe. With this operation, the heat pump device can reduce the amount of refrigerant passing through the evaporator without reducing the amount of refrigerant to be used for supplying heat to the load, and can evaporate the refrigerant having passed through the evaporator, while increasing the low-pressure side pressure in the main refrigerant circuit. The controller selects, from among the plurality of main circuit expansion devices in a parallel-connected relationship, the main circuit expansion device based on the suction pressure, and can thus control the selected main circuit expansion device appropriately to the environment. Therefore, even when being installed at a location where the outside temperature is low, the heat-pump hot water supply device still does not need to include an accumulator, and can thus be downsized.

BRIEF DESCRIPTION OF DRAWINGS

FIG. 5 illustrates an example of the relationship between outside-air temperature, outflow heat-medium temperature, and upper limit of driving frequency of a compressor 110 in the heat-pump hot water supply device 100 according to Embodiment 4.

DESCRIPTION OF EMBODIMENTS

Figure 1:
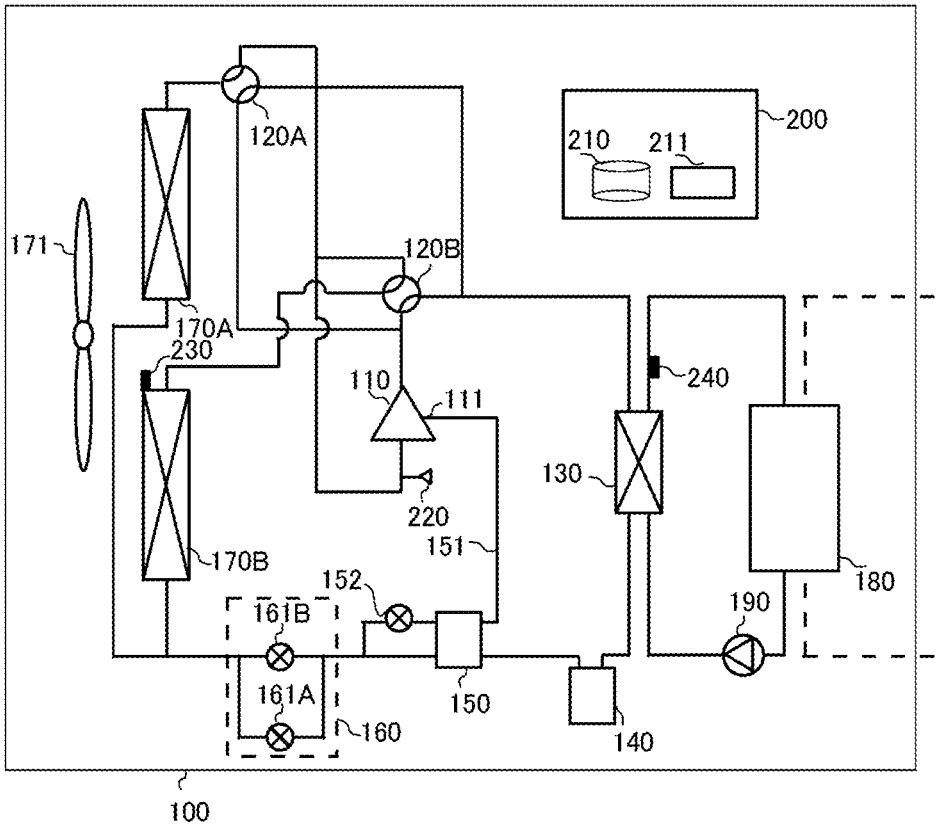
FIG. 1 illustrates an example of the device configuration of a heat pump device according to Embodiment 1.

Hereinafter, a heat pump device and other devices according to an embodiment will be described with reference to drawings, etc. In the drawings below, like reference signs denote similar or corresponding components, and are common throughout the entire descriptions of the embodiments described below. In addition, the relationship of sizes of the components in the drawings described below may differ from that of actual ones. The forms of the constituent elements described throughout the entire specification are merely examples, and do not intend to limit the constituent elements to the forms described in the specification. It may be allowable that all of the devices described in the specification are not necessarily included. In particular, the combination of constituent elements is not limited to only the combination in each embodiment, and the constituent elements described in one embodiment can be applied to another embodiment. Furthermore, the level of the pressure and temperature is not particularly determined in relation to an absolute value, but is determined relative to the conditions and operation of the device and the like. In addition, when there is no need to distinguish or identify a plurality of devices of the same type that are distinguished by subscripts, reference signs and the subscripts may be omitted.

Embodiment 1

FIG. 1 illustrates an example of the device configuration of a heat pump device according to Embodiment 1. The heat pump device in Embodiment 1 is described as being a heat-pump hot water supply device 100 that heats water and supplies the heated water. The heat-pump hot water supply device 100 in Embodiment 1 has a main refrigerant circuit in which a compressor 110, flow switching devices 120, a load side heat exchanger 130, a refrigerant tank 140, an auxiliary heat exchanger 150, a main circuit expansion device unit 160, and heat source side heat exchangers 170 are connected annularly by refrigerant pipes. Refrigerant circulates in the main refrigerant circuit. The heat-pump hot water supply device 100 in FIG. 1 includes two units of the flow switching devices 120, two units of main circuit expansion devices 161 making up the main circuit expansion device unit 160, and two units of the heat source side heat exchangers 170. A flow switching device 120A and a flow switching device 120B are installed in a parallel-connected relationship to the main refrigerant circuit. A main circuit expansion device 161A and a main circuit expansion device 161B are installed in a parallel-connected relationship to the main refrigerant circuit. A heat source side heat exchanger 170A and a heat source side heat exchanger 170B are installed in a parallel-connected relationship to the main refrigerant circuit. The heat-pump hot water supply device 100 includes two units of the flow switching devices 120 and two units of the heat source side heat exchangers 170, so that one of the heat source side heat exchangers 170 can serve as an evaporator to defrost the other heat source side heat exchanger 170. However, the configuration of the flow switching devices 120 and the heat source side heat exchangers 170 in the heat-pump hot water supply device 100 in Embodiment 1 is not limited to such a configuration as described above.

The heat-pump hot water supply device 100 includes an injection flow passage that branches off from the refrigerant pipe of the main refrigerant circuit located between the heat source side heat exchanger 170 and the auxiliary heat exchanger 150 to allow refrigerant to flow into the compressor 110 through the injection flow passage. Further, the heat-pump hot water supply device 100 has a water circuit in which the load side heat exchanger 130, a hot water tank 180, and a hot water pump 190 are connected to allow water as a heating target to pass through the water circuit.

The compressor 110 suctions and compresses low-temperature low-pressure gas refrigerant into a state of high-temperature high-pressure gas refrigerant, and discharges the high-temperature high-pressure gas refrigerant. The compressor 110 is constituted by, for example, an inverter compressor whose capacity is controllable by varying its driving frequency. For example, the compressor 110 has a low-pressure shell structure. The low-pressure shell structure compressor includes a compression chamber in its hermetically sealed container. The inside of the hermetically sealed container is in a low-pressure refrigerant atmosphere, so that the compressor suctions and compresses the low-pressure refrigerant in the hermetically sealed container. The compressor 110 in Embodiment 1 is of a structure having an injection port 111 through which refrigerant can flow into the compression chamber from the outside. Therefore, in the compressor 110 in Embodiment 1, intermediate injection can be performed to inject the refrigerant, flowing into the compressor 110 from the outside through the injection port 111, to another refrigerant that is in the process of being compressed.

In Embodiment 1, the load side heat exchanger 130 serves as a condenser. Through the load side heat exchanger 130, refrigerant exchanges heat with water passing through the water circuit as a heat-exchange target, so that the refrigerant transfers heat to the water and heats the water. Therefore, the water is a load for the main refrigerant circuit. The refrigerant tank 140 serves as a receiver and is configured to temporarily store refrigerant in liquid form. The main circuit expansion device unit 160 reduces the pressure of high-pressure refrigerant, and regulates the pressure and flow rate of the refrigerant. In the heat-pump hot water supply device 100 in Embodiment 1, the main circuit expansion device unit 160 includes a plurality of main circuit expansion devices 161 with different capacities. Each of the main circuit expansion devices 161 is an electronic expansion valve or other device that is configured to control the opening degree (opening area) continuously or in multiple stages under the control of a controller 200 that will be described later. As described above, the heat-pump hot water supply device 100 in FIG. 1 has two units of the main circuit expansion devices 161A and 161B installed therein and connected in parallel to the main refrigerant circuit. The main circuit expansion device 161A has a maximum opening area that is smaller than that of the main circuit expansion device 161B, while the main circuit expansion device 161A can minutely regulate its capacity. In contrast, the main circuit expansion device 161B has a maximum opening area that is larger than that of the main circuit expansion device 161A and is used for normal operation and the like.

Through the auxiliary heat exchanger 150, refrigerant passing through the main refrigerant circuit exchanges heat with refrigerant passing through the injection flow passage. Through the auxiliary heat exchanger 150, the refrigerant passing through the main refrigerant circuit is subcooled by the heat exchange between the refrigerants, and the quality of the refrigerant passing through the injection flow passage is increased. In the heat source side heat exchangers 170, the refrigerant passing through the heat source side heat exchangers 170 exchanges heat with outside air such as outdoor air, and thus evaporates. The fan 171 delivers the outside air to the heat source side heat exchangers 170 and helps heat exchange in the heat source side heat exchangers 170.

The injection pipe 151 forms the injection flow passage. One end of the injection pipe 151 is connected to the refrigerant pipe between the heat source side heat exchangers 170 and the auxiliary heat exchanger 150, while the other end of the injection pipe 151 is connected to the injection port 111 of the compressor 110. The refrigerant passing through the injection pipe 151 flows into the compression chamber of the compressor 110. At this time, the refrigerant flowing into the compression chamber is at high pressure or intermediate pressure. The intermediate pressure is lower than a high-pressure side pressure in the main refrigerant circuit (for example, a refrigerant pressure in the condenser or a discharge pressure on the discharge side of the compressor 110), and is higher than a low-pressure side pressure in the main refrigerant circuit (for example, a refrigerant pressure in the evaporator or a suction pressure on the suction side of the compressor 110).

An injection expansion device 152 is installed in the injection pipe 151. The injection expansion device 152 regulates the amount and pressure of refrigerant passing through the injection pipe 151 and flowing into the injection port 111 of the compressor 110. The injection expansion device 152 is an electronic expansion valve or other device that is configured to control the opening degree continuously or in multiple stages under the control of the controller 200 that will be described later.

In the water circuit in the heat-pump hot water supply device 100 in Embodiment 1, the load side heat exchanger 130, the hot water tank 180, and the hot water pump 190 are connected annularly by pipes. In the water circuit, water to be supplied as hot water circulates. The hot water tank 180 stores the water to be supplied as hot water. The hot water pump 190 pressurizes the water to be supplied as hot water and causes the pressurized water to circulate in the water circuit.

The heat-pump hot water supply device 100 includes the controller 200. The controller 200 controls the operation of the heat-pump hot water supply device 100 in its entirety based on a detection signal transmitted from the various types of sensors described above and an instruction from a remote control (not illustrated). For example, the controller 200 controls the driving frequency of the compressor 110. The controller 200 also controls the opening degree of the injection expansion device 152, and controls the opening degree of the main circuit expansion devices 161 in the main circuit expansion device unit 160 based on the suction pressure of the compressor 110. The controller 200 controls driving of the hot water pump 190. While the controller 200 executes these controls, the heat-pump hot water supply device 100 works.

The controller 200 includes a microcomputer. The microcomputer includes, for example, a control arithmetic processor such as a central processing unit (CPU). The controller 200 includes an I/O port configured to manage inputs and outputs of various types of signals. The microcomputer also includes, as a storage device 210, a volatile storage device (not illustrated) configured to store data temporarily such as a random access memory (RAM), and a nonvolatile auxiliary storage device (not illustrated) such as a hard disk and a flash memory. The storage device 210 has data in which a procedure for the processing that is performed by the control arithmetic processor is programmed. The control arithmetic processor performs the processing based on the program data to implement the processing of each unit. However, the controller 200 is not limited thereto. Each device may be constituted by a dedicated device (hardware). The controller 200 includes a time measurement device 211 configured to measure time, such as a timer. The heat-pump hot water supply device 100 in FIG. 1 has the controller 200 installed therein. However, the installation location of the controller 200 is not particularly limited.

The heat-pump hot water supply device 100 includes a suction pressure sensor 220, an outside-air temperature sensor 230, and an outflow-side water temperature sensor 240. The suction pressure sensor 220 serving as a suction pressure detection device detects a pressure of refrigerant to be suctioned into the compressor 110, and outputs a suction pressure detection signal. The outside-air temperature sensor 230 serving as an outside-air temperature detection device is installed on an air inflow portion of the heat source side heat exchanger 170. For example, the outside-air temperature sensor 230 detects an outside-air temperature that is an ambient temperature around the installation location of the heat-pump hot water supply device 100, and outputs an outside-air temperature detection signal. The outflow-side water temperature sensor 240 serving as a load temperature detection device detects an outgoing-water temperature of the water flowing out from the load side heat exchanger 130 in the water circuit, and outputs a load temperature detection signal.

Figure 2:
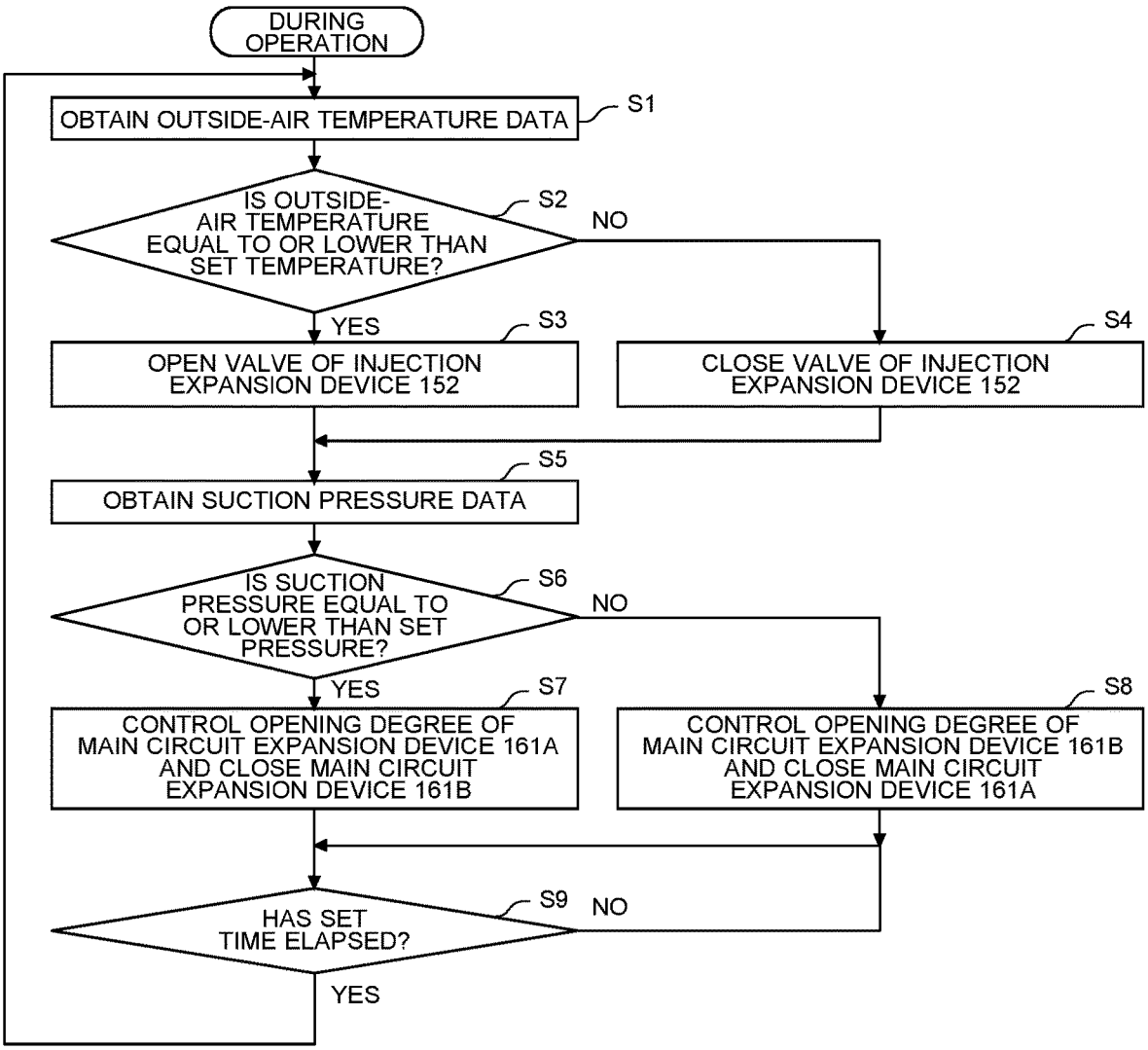
FIG. 2 illustrates a flow of the processing for operation of a heat-pump hot water supply device 100 in Embodiment 1.

FIG. 2 illustrates a flow of the processing for operation of the heat-pump hot water supply device 100 in Embodiment 1. The controller 200 is supposed to perform the processing illustrated in FIG. 2. With reference to FIG. 2, the control processing that is performed during operation of the heat-pump hot water supply device 100 in Embodiment 1 is described below.

During normal operation, the controller 200 obtains outside-air temperature data included in an outside-air temperature detection signal from the outside-air temperature sensor 230 (step S1). The controller 200 determines whether the outside-air temperature is equal to or lower than a set operational temperature that is set in advance (step S2). Although not particularly limited, the set operational temperature is supposed to be, for example, −20 [degrees C.].

When the controller 200 determines that the outside-air temperature is equal to or lower than the set operational temperature of −20 [degrees C.], the controller 200 transmits an instruction signal to the injection expansion device 152 to open a valve by a set opening degree that is set in advance (step S3). The set opening degree is not particularly limited. However, the valve in a closed state is supposed to be opened by an initial opening degree. The set opening degree subsequent to the initial opening degree is incremented by, for example, 10% from the initial opening degree. In contrast, when the controller 200 determines that the outside-air temperature is higher than −20 [degrees C.], the controller 200 transmits an instruction signal to the injection expansion device 152 to close the valve to block the refrigerant from passing through the injection flow passage (step S4). The wording "close the injection expansion device 152" also includes the meaning that the injection expansion device 152 remains in a closed state when having already been closed (the same applies hereinafter).

The controller 200 obtains suction pressure data included in the suction pressure detection signal from the suction pressure sensor 220 (step S5). The controller 200 determines whether the suction pressure is equal to or lower than a set pressure that is set in advance (step S6). Although not particularly limited, the set pressure is supposed to be, for example, 0.10 [MPa]. When the controller 200 determines that the suction pressure is equal to or lower than the set pressure of 0.10 [MPa], the controller 200 closes the main circuit expansion device 161B and controls the opening degree of the main circuit expansion device 161A (step S7). In contrast, when the controller 200 determines that the suction pressure is higher than the set pressure of 0.10 [MPa], the controller 200 closes the main circuit expansion device 161A and controls the opening degree of the main circuit expansion device 161B (step S8). In step S8, the controller 200 is described as closing the main circuit expansion device 161A. However, the controller 200 may open both the main circuit expansion device 161A and the main circuit expansion device 161B and control their opening degrees.

When the controller 200 determines that the set time has elapsed based on the time measured by the time measurement device 211 (step S9), the controller 200 returns to step S1 to continue the processing. Although not particularly limited, the set time is supposed to be equal to or longer than 1 [min].

As described above, in the heat-pump hot water supply device 100 in Embodiment 1, during its operation, the controller 200 opens the injection expansion device 152 based on the outside-air temperature. As the injection expansion device 152 is open, refrigerant flows through the injection pipe 151, so that the intermediate injection is performed to directly inject the refrigerant into the compressor 110 from the injection port 111 included in the compressor 110. Consequently, the heat-pump hot water supply device 100 can maintain heating of water that is a load without reducing the amount of refrigerant to be condensed in the load side heat exchanger 130. Simultaneously, the heat-pump hot water supply device 100 reduces the amount of refrigerant passing through the heat source side heat exchangers 170 serving as an evaporator through which the reduced amount of refrigerant evaporates, and can increase the low-pressure side pressure in the main refrigerant circuit. Therefore, the heat-pump hot water supply device 100 in Embodiment 1 does not need to include the accumulator, and can thus be downsized.

In the heat-pump hot water supply device 100 in Embodiment 1, the main circuit expansion device unit 160 includes the plurality of main circuit expansion devices 161 with different capacities and connected in parallel to the main refrigerant circuit. With this configuration, when the controller 200 determines that the outside-air temperature is low and the low-pressure side pressure in the main refrigerant circuit is equal to or lower than the set pressure of 0.1 [MPa], the controller 200 opens and controls the main circuit expansion device 161A whose opening area is minutely controllable. This control can prevent a sharp decrease in the low-pressure side pressure in the main refrigerant circuit, and can accordingly reduce the generation of liquid refrigerant. When the low-pressure side pressure in the main refrigerant circuit is higher than the set pressure of 0.1 [MPa], the controller 200 uses the main circuit expansion device 161B to perform normal operation.

The heat-pump hot water supply device 100 in Embodiment 1 includes the auxiliary heat exchanger 150. Through the auxiliary heat exchanger 150, the refrigerant passing through the main refrigerant circuit is subcooled, and the quality of the refrigerant passing through the injection flow passage can be increased. This can prevent the liquid refrigerant from being injected for the intermediate injection.

Embodiment 2

Figure 3:
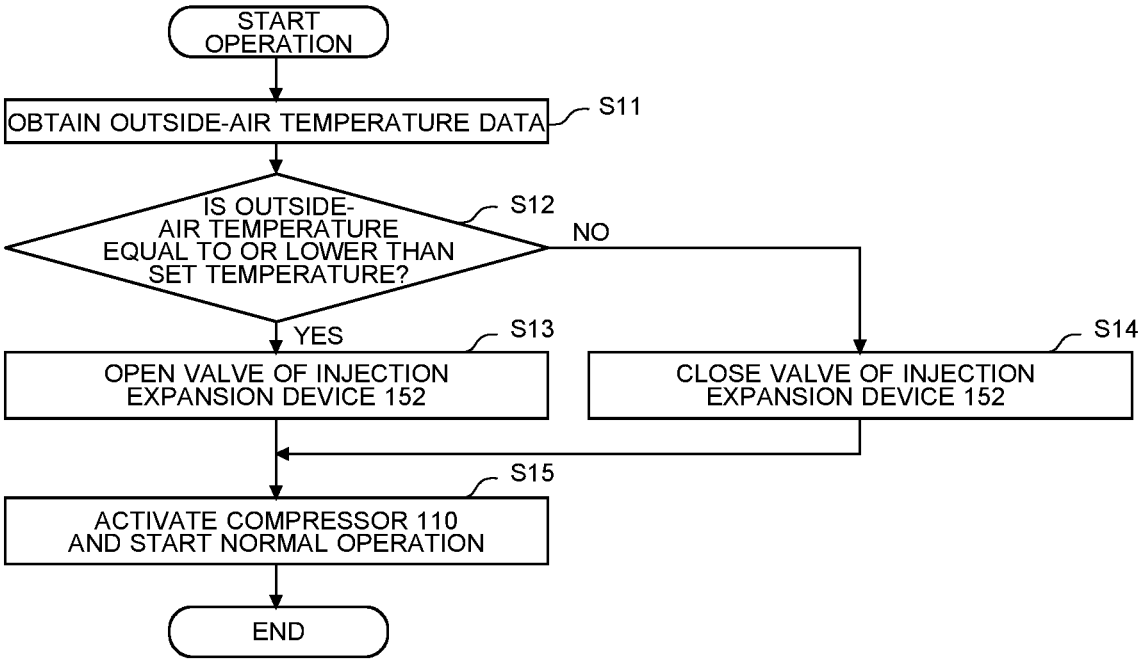
FIG. 3 illustrates a flow of the processing for the heat-pump hot water supply device 100 in Embodiment 2.

FIG. 3 illustrates a flow of the processing for the heat-pump hot water supply device 100 in Embodiment 2. The heat-pump hot water supply device 100 in Embodiment 2 has the same configuration as that illustrated in FIG. 1 and described in Embodiment 1. The controller 200 is supposed to also perform the processing illustrated in FIG. 3 in the same manner as in Embodiment 1. The processing described as being performed by the controller 200 in Embodiment 1 is the processing to be performed during normal operation. In Embodiment 2, the processing to be performed when the controller 200 activates the compressor 110, such as at the start of operation, is described below.

Upon turning on of a switch or the like to instruct the controller 200 to start operation, the controller 200 obtains outside-air temperature data included in an outside-air temperature detection signal from the outside-air temperature sensor 230 (step S11). The controller 200 determines whether the outside-air temperature is equal to or lower than a set activation temperature that is set in advance (step S12). Although not particularly limited, the set activation temperature is supposed to be, for example, −20 [degrees C.], which is the same as the set operational temperature in Embodiment 1.

When the controller 200 determines that the outside-air temperature is equal to or lower than the set activation temperature of −20 [degrees C.], the controller 200 transmits an instruction signal to the injection expansion device 152 to open a valve by an initially-set opening degree that is set in advance (step S13). The controller 200 activates the compressor 110 to perform normal operation (step S14). The initially-set opening degree is not limited to a particular value. In contrast, when the controller 200 determines that the outside-air temperature is higher than −20 [degrees C.], the controller 200 activates the compressor 110 with the injection expansion device 152 remaining closed to perform normal operation (step S15).

As described above, in the heat-pump hot water supply device 100 in Embodiment 2, at the time of activating the compressor 110, the controller 200 opens the injection expansion device 152 based on the outside-air temperature, and controls the injection expansion device 152 to perform the intermediate injection. Then, the controller 200 activates the compressor 110. This can prevent a sharp decrease in the low-pressure side pressure in the refrigerant circuit.

Embodiment 3

Figure 4:
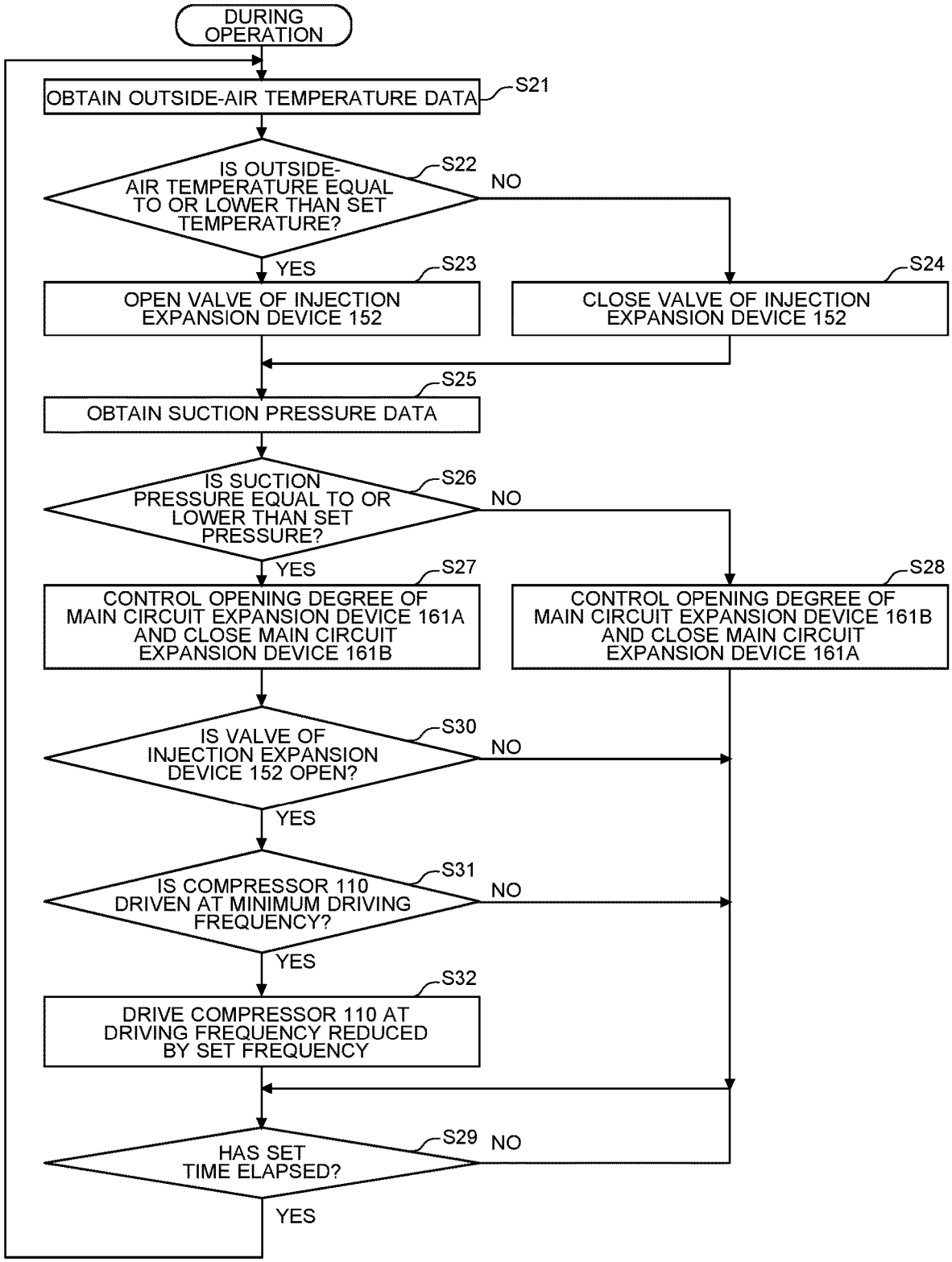
FIG. 4 illustrates a flow of the processing for the heat-pump hot water supply device 100 in Embodiment 3.

FIG. 4 illustrates a flow of the processing for the heat-pump hot water supply device 100 in Embodiment 3. The heat-pump hot water supply device 100 in Embodiment 3 has the same configuration as that illustrated in FIG. 1 and described in Embodiment 1. The controller 200 is supposed to perform the processing illustrated in FIG. 4. In the main refrigerant circuit, in general, when the driving frequency of the compressor 110 is higher than the assumed driving frequency, the low-pressure side refrigerant pressure in the main refrigerant circuit is decreased. In view of that, in the heat-pump hot water supply device 100 in Embodiment 3, the controller 200 forcibly decreases the driving frequency of the compressor 110 when the controller 200 determines that the low-pressure side refrigerant pressure in the main refrigerant circuit is decreased. As the driving frequency of the compressor 110 is decreased, the suction pressure of the compressor 110 can be increased and the discharge pressure can be decreased accordingly.

The processing in steps S21 to S29 illustrated in FIG. 4 is performed by the controller 200 in the same manner as the processing in steps S1 to S9 described in Embodiment 1. In Embodiment 3, when the low-pressure side pressure in the main refrigerant circuit is regulated by the main circuit expansion device 161B in step S27, the controller 200 determines whether the injection expansion device 152 is open (step S30). When the controller 200 determines that the injection expansion device 152 is open and its opening degree is controlled, the controller 200 further determines whether the compressor 110 is driven at a minimum driving frequency (step S31).

When the controller 200 determines that the compressor 110 is not driven at a minimum driving frequency, the controller 200 decreases the driving frequency of the compressor 110 (step S32). The driving frequency of the compressor 110 is supposed to be decreased by a set frequency that is set in advance. Although the set frequency is not particularly limited, the controller 200 drives the compressor 110 at, for example, a driving frequency that is reduced by 10% of the driving frequency of the compressor 110. When the controller 200 determines that the set time has elapsed based on the time measured by the time measurement device 211 (step S29), the controller 200 returns to step S21 to continue the processing.

In contrast, when the controller 200 determines that the injection expansion device 152 is closed in step S30 or determining that the compressor 110 is driven at a minimum driving frequency in step S31, the controller 200 determines whether the set time has elapsed (step S29). When the controller 200 determines that the set time has elapsed, the controller 200 returns to step S21 to continue the processing.

As described above, in the heat-pump hot water supply device 100 in Embodiment 3, the controller 200 reduces the driving frequency of the compressor 110 and drives the compressor 110 at the reduced driving frequency when the controller 200 determines that the injection expansion device 152 is open and the suction pressure is lower than the set pressure. This can further ensure that the low-pressure side refrigerant pressure in the main refrigerant circuit is increased.

Embodiment 4

FIG. 5 illustrates an example of the relationship between outside-air temperature, outflow heat-medium temperature, and upper limit of driving frequency of the compressor 110 in the heat-pump hot water supply device 100 according to Embodiment 4. The heat-pump hot water supply device 100 in Embodiment 4 has the same configuration as that illustrated in FIG. 1 and described in Embodiment 1. FIG. 5 illustrates the relationship in a table format. In FIG. 5, the relationship is between outside-air temperature [degrees C.], outgoing-water temperature [degrees C.], and upper limit [Hz] of driving frequency of the compressor 110. The outgoing-water temperature is detected by the outflow-side water temperature sensor 240 and is used as data showing the condition of the load. In FIG. 5, the outgoing-water temperature is used as the data showing the condition of the load. However, the data is not limited to this outgoing-water temperature. For example, an incoming-water temperature of the water flowing into the load side heat exchanger 130 may be used as the data showing the condition of the load.

In Embodiment 3, the controller 200 is configured to reduce the driving frequency of the compressor 110 to increase the low-pressure side pressure in the main refrigerant circuit. However, a decrease in the low-pressure side pressure in the main refrigerant circuit can suddenly occur in a short time. For this reason, there is a possibility that the controller 200 may not be ready in time for performing the processing on the compressor 110. In view of that, the heat-pump hot water supply device 100 in Embodiment 4 defines an upper limit of driving frequency for the compressor 110 in advance as driving-frequency upper limit data based on the outside-air temperature and the condition of the load.

Thus, as illustrated in FIG. 5, the storage device 210 stores therein the data relating to the defined upper limit of driving frequency. The controller 200 controls driving of the compressor 110 at a driving frequency equal to or lower than the defined upper limit.

As described above, in the heat-pump hot water supply device 100 in Embodiment 4, the storage device 210 stores therein the data relating to the relationship between outside-air temperature, outflow heat-medium temperature showing the condition of the load, and upper limit of driving frequency of the compressor 110. The controller 200 controls driving of the compressor 110 at a driving frequency equal to or lower than the upper limit based on the outside-air temperature and the condition of the load. With this control, the controller 200 can cope with a possible sharp decrease in the low-pressure side pressure in the main refrigerant circuit.

INDUSTRIAL APPLICABILITY

In Embodiment 1 described above, the heat-pump hot water supply device 100 has been explained as an example of the heat pump device. However, the heat pump device is not limited to this example. The heat pump device is also applicable to, for example, an air-conditioning apparatus, a heating apparatus, or other heat pump devices having a refrigerant circuit.

REFERENCE SIGNS LIST

100: heat-pump hot water supply device, 110: compressor, 111: injection port, 120, 120A, 120B: flow switching device, 130: load side heat exchanger, 140: refrigerant tank, 150: auxiliary heat exchanger, 151: injection pipe, 152: injection expansion device, 160: main circuit expansion device unit, 161, 161A, 161B: main circuit expansion device, 170, 170A, 170B: heat source side heat exchanger, 171: fan, 180: hot water tank, 190: hot water pump, 200:

controller, 210: storage device, 211: time measurement device, 220: suction pressure sensor, 230: outside-air temperature sensor, 240: outflow-side water temperature sensor

The invention claimed is:

1. A heat pump device comprising:

a main refrigerant circuit in which a compressor, a condenser, a main circuit expansion device unit, and an evaporator are connected by pipes to allow refrigerant to circulate in the main refrigerant circuit, the compressor having an injection port and being configured to compress and discharge the refrigerant, the refrigerant exchanging heat with a load through the condenser, the main circuit expansion device unit being configured to reduce a pressure of the refrigerant, the refrigerant exchanging heat with outside air through the evaporator;

an injection pipe connected at one end to a pipe between the condenser and the main circuit expansion device unit, and connected at an other end to the injection port;

an injection expansion valve configured to regulate an opening degree to regulate an amount of the refrigerant flowing through the injection pipe;

an outside-air temperature sensor configured to detect a temperature of the outside air;

a suction pressure sensor configured to detect a suction pressure of the refrigerant to be suctioned into the compressor; and a controller, wherein the main circuit expansion device unit includes a plurality of main circuit expansion valves with different maximum opening areas and different capacities and in a parallel-connected relationship, and during operation, when the controller determines that the temperature of the outside air is equal to or lower than a set operational temperature that is set in advance based on the temperature of the outside air, the controller is configured to open the injection expansion valve to control an opening degree thereof, and is configured to select, from among the plurality of main circuit expansion valves of the main circuit expansion device unit, a selected main circuit expansion valve based on the suction pressure to control an opening degree of the selected main circuit expansion valve.

2. The heat pump device of claim 1, wherein when the controller determines, at a time of activating the compressor, that the temperature of the outside air is equal to or lower than a set activation temperature that is set in advance based on the temperature of the outside air, the controller is configured to open the injection expansion valve to activate the compressor.

3. The heat pump device of claim 2, comprising:

a load temperature detection device configured to detect a temperature of the load exchanging heat at the condenser as a load temperature; and a storage configured to store therein driving-frequency upper limit data in which the temperature of the outside air and the load temperature are associated with an upper limit of a driving frequency of the compressor, wherein the controller is configured to control driving of the compressor within a range of the driving-frequency upper limit data defined based on the temperature of the outside air and a condition of the load.

4. The heat pump device of claim 2, comprising an auxiliary heat exchanger through which the refrigerant flowing from the condenser to the main circuit expansion valve exchanges heat with the refrigerant passing through the injection expansion valve and flowing through the injection pipe.

5. A hot water supply device comprising the heat pump device of claim 2, and supplying hot water.

6. The heat pump device of claim 1, comprising:

a load temperature detection device configured to detect a temperature of the load exchanging heat at the condenser as a load temperature; and a storage configured to store therein driving-frequency upper limit data in which the temperature of the outside air and the load temperature are associated with an upper limit of a driving frequency of the compressor, wherein the controller is configured to control driving of the compressor within a range of the driving-frequency upper limit data defined based on the temperature of the outside air and a condition of the load.

7. The heat pump device of claim 1, comprising an auxiliary heat exchanger through which the refrigerant flowing from the condenser to the main circuit expansion valve exchanges heat with the refrigerant passing through the injection expansion valve and flowing through the injection pipe.

8. A hot water supply device comprising the heat pump device of claim 1, and supplying hot water.

9. The heat pump device of claim 1, wherein the injection pipe is connected at the one end to a portion of the pipe between the condenser and the main circuit expansion device unit feeding into the main circuit expansion device unit.

10. A heat pump device comprising:

a main refrigerant circuit in which a compressor, a condenser, a main circuit expansion device unit, and an evaporator are connected by pipes to allow refrigerant to circulate in the main refrigerant circuit, the compressor having an injection port and being configured to compress and discharge the refrigerant, the refrigerant exchanging heat with a load through the condenser, the main circuit expansion device unit being configured to reduce a pressure of the refrigerant, the refrigerant exchanging heat with outside air through the evaporator;

an injection pipe connected at one end to a pipe between the condenser and the main circuit expansion device unit, and connected at an other end to the injection port;

an injection expansion valve configured to regulate an opening degree to regulate an amount of the refrigerant flowing through the injection pipe;

an outside-air temperature sensor configured to detect a temperature of the outside air;

a suction pressure sensor configured to detect a suction pressure of the refrigerant to be suctioned into the compressor; and a controller, wherein the main circuit expansion device unit includes a plurality of main circuit expansion valves with different capacities and in a parallel-connected relationship, and during operation, when the controller determines that the temperature of the outside air is equal to or lower than a set operational temperature that is set in advance based on the temperature of the outside air, the controller is configured to open the injection expansion valve to control an opening degree thereof, and is configured to select, from among the plurality of main circuit expansion valves of the main circuit expansion device unit, a selected main circuit expansion valve based on the suction pressure to control an opening degree of the selected main circuit expansion valve, wherein when the controller determines that the injection expansion valve is open and the suction pressure is equal to or lower than a set pressure that is set in advance, the controller is configured to perform control to drive the compressor with a driving frequency of the compressor being reduced.

11. The heat pump device of claim 10, wherein when the controller determines, at a time of activating the compressor, that the temperature of the outside air is equal to or lower than a set activation temperature that is set in advance based on the temperature of the outside air, the controller is configured to open the injection expansion valve to activate the compressor.

12. The heat pump device of claim 11, comprising:

a load temperature detection device configured to detect a temperature of the load exchanging heat at the condenser as a load temperature; and a storage configured to store therein driving-frequency upper limit data in which the temperature of the outside air and the load temperature are associated with an upper limit of a driving frequency of the compressor, wherein the controller is configured to control driving of the compressor within a range of the driving-frequency upper limit data defined based on the temperature of the outside air and a condition of the load.

13. The heat pump device of claim 11, comprising an auxiliary heat exchanger through which the refrigerant flowing from the condenser to the main circuit expansion valve exchanges heat with the refrigerant passing through the injection expansion valve and flowing through the injection pipe.

14. A hot water supply device comprising the heat pump device of claim 11, and supplying hot water.

15. The heat pump device of claim 10, comprising:

a load temperature detection device configured to detect a temperature of the load exchanging heat at the condenser as a load temperature; and a storage configured to store therein driving-frequency upper limit data in which the temperature of the outside air and the load temperature are associated with an upper limit of a driving frequency of the compressor, wherein the controller is configured to control driving of the compressor within a range of the driving-frequency upper limit data defined based on the temperature of the outside air and a condition of the load.

16. The heat pump device of claim 10, comprising an auxiliary heat exchanger through which the refrigerant flowing from the condenser to the main circuit expansion valve exchanges heat with the refrigerant passing through the injection expansion valve and flowing through the injection pipe.

17. A hot water supply device comprising the heat pump device of claim 10, and supplying hot water.

18. The heat pump device of claim 10, wherein the injection pipe is connected at the one end to a portion of the pipe between the condenser and the main circuit expansion device unit feeding into the main circuit expansion device unit.

* * * * *